United States Patent [19]

Ramesohl et al.

[11] 4,259,062

[45] Mar. 31, 1981

[54] APPARATUS FOR COOLING OF CEMENT CLINKER OR THE LIKE

[75] Inventors: Hubert Ramesohl, Bergisch Gladbach; Horst Herchenbach, Troisdorf; Karlheinz Schröder, Cologne, all of Fed. Rep. of Germany

[73] Assignee: Klöckner-Humboldt-Deutz AG, Fed. Rep. of Germany

[21] Appl. No.: 4,170

[22] Filed: Jan. 17, 1979

[30] Foreign Application Priority Data

Jan. 18, 1978 [DE] Fed. Rep. of Germany ..... 2801967

[51] Int. Cl.[3] ..... F27D 15/02

[52] U.S. Cl. ..... 432/78; 110/165 R

[58] Field of Search ..... 110/165 R, 259, 165; 34/236, 57 C, 209, 210, 216, 217; 198/952; 432/15, 80, 78

[56] References Cited

U.S. PATENT DOCUMENTS

| | | | |
|---|---|---|---|
| 3,836,321 | 9/1974 | Kobayashi et al. | 34/57 C X |
| 4,089,634 | 5/1978 | Sylvest | 432/80 |

FOREIGN PATENT DOCUMENTS

| | | | |
|---|---|---|---|
| 1341236 | 12/1973 | United Kingdom | 432/78 |

*Primary Examiner*—Charles A. Ruehl

*Attorney, Agent, or Firm*—Hill, Van Santen, Steadman, Chiara & Simpson

[57] ABSTRACT

Apparatus for the cooling of cement clinker or the like being discharged from a rotary kiln, the apparatus including at least two cooling means arranged to receive the discharge from the rotary kiln and adjustably positionable distributor means arranged to proportion the discharge of the rotary kiln selectively between the two or more cooling means.

3 Claims, 2 Drawing Figures

APPARATUS FOR COOLING OF CEMENT CLINKER OR THE LIKE

BACKGROUND OF THE INVENTION

1. Field of the Invention

This invention is in the field of cooling devices for particulate material, particularly for the cooling of cement clinker being discharged from a rotary kiln, and including at least two cooling systems in parallel relationship, with distributor means being used to selectively proportion the discharge of the rotary kiln between the two systems.

2. Description of the Prior Art

In German Pat. No. 917,716 there is described a rotary kiln which has two cooling devices connected consecutively, the first of which is connected adjacent the rotary kiln in the form of a step grate, and the second is a pipe cooler. As production is increased, however, there are problems of construction and operation both with the grate coolers as well as with the pipe cooler. For the attainment of a predetermined cooling effect in the pipe cooler, the gas velocity must be limited so that with increasing throughput of cooling material, very great pipe diameters must result. With such pipe coolers, the wear is increased through the increased dropping height which the more or less coarse materials being treated encounter in being rolled about in the cooling pipe. Because of the relatively low stability of shape of such very large cooling pipes, special construction means must be undertaken to provide stiffening of the pipe. Similarly, a grate cooler, with increasing output, requires a larger width and length, so that for a uniform cooling effect there must be a uniform material bed developed of a predetermined height. When the material to be cooled leaves the rotary kiln, however, in the form of a limited stream, special and usually very expensive means must be employed to make sure that there is a uniform distribution of the material to be cooled over the entire width of the grate. A non-uniform distribution of material results in obstructions, deposits, or caking, an impaired cooling effect, as well as an increased wear due, among other things, to local overheating. The utilization of a cooling apparatus in accordance with the aforesaid German Pat. No. 917,716 is economically feasible, because of the expenditure of maintenance and operational costs, only up to outputs or yields of approximately 2,500 metric tons per day.

SUMMARY OF THE INVENTION

The present invention provides an apparatus for the cooling of cement clinker or similar materials which does not have inherent limitations on its output, and provides economical, uniform and effective cooling. In general, the apparatus of the present invention provides a rotary kiln in combination with at least two cooling means which may both be pipe coolers, both grate coolers, or a combination of the two. The material leaving the rotary kiln is distributed by means of an adjustable distributor member to the several pipe coolers or grate coolers, each one of which has a size which can be utilized efficiently so that an economical operation is possible even with large installations.

In this manner, limiations relative to the output of the rotary kiln are eliminated as a corresponding number of appropriate coolers can be combined through the distributor member. The direction of feed, for example, of at least two pipe coolers may coincide with that of the rotary kiln but they may also have opposite directions. In individual cases, it may be suitable to arrange the pipe cooler so that its directions of feed extend exactly in opposite directions to one another and opposite to the direction of the feed of the rotary kiln or, alternatively, at a desired angle to this direction. The cooling apparatus of the present invention offers the further advantage that malfunctions in operation of one of the pipe coolers or grate coolers does not necessitate a stoppage of the entire rotary kiln installation. Instead, the cooling apparatus may be operated further with lessened cooling output and/or diminished total output. Because of this possibility of a partial load operation, time losses in production through repair or reconditioning work are held to within narrow limits so that availability of the total rotary kiln installation and therefore its economy are decisively increased.

In a particularly preferred form of the present invention, the pipe coolers or grate coolers are arranged parallel to one another. This parallel arrangement is such that the feed directions of the pipe coolers or grate coolers correspond to each other or they may extend at a desired angle to the axis of the rotary kiln to accommodate specific spatial conditions. In this manner, the material to be cooled after passing through the pipe or grate cooler may be combined by various types of conveyor means in a simple manner and delivered to a further treatment stage such as, for example, a grinding installation or a clinker silo.

BRIEF DESCRIPTION OF THE DRAWINGS

The present invention is described by way of example in the drawings, in which.

DESCRIPTION OF THE PREFERRED EMBODIMENTS

Figure 1:
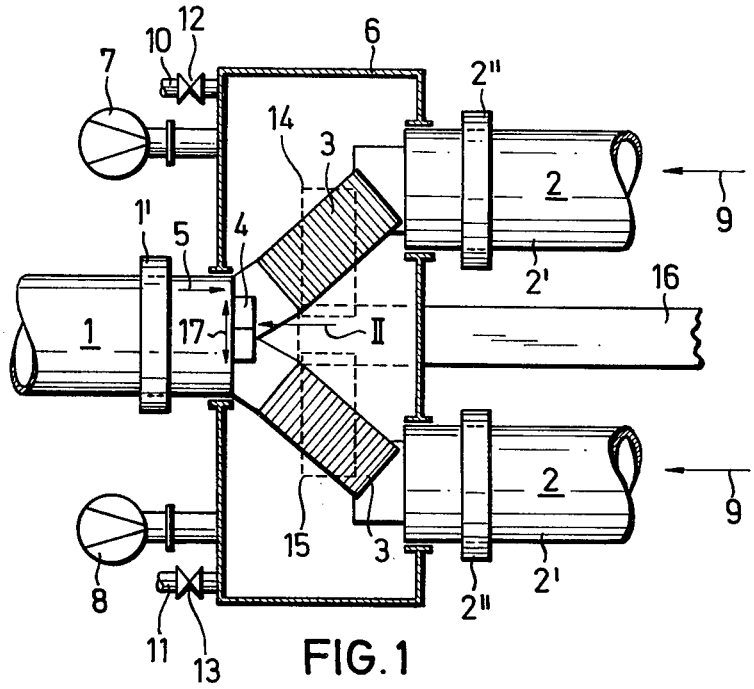
FIG. 1 is an embodiment of the invention illustrating a particular apparatus in plan view, with portions thereof being broken away.

In FIG. 1, there is illustrated a rotary kiln 1, with two pipe coolers 2 extending in the direction of feed of the rotary kiln and extending parallel to each other. A pair of grate coolers 3 are connected in series with each of the pipe coolers 2.

At the furnace outlet, there is located a distributor member 4 which divides the stream of material issuing from the rotary kiln 1 in the direction of the arrow 5 into two partial streams which are delivered to the grate coolers 3 and eventually into the pipe coolers 2. Instead of the pipe coolers 2, grate coolers illustrated schematically at 2' may also be used.

The rotary kiln 1 and the pipe coolers 2 are positioned for rotation by means of rollers 1' and 2'', respectively, in a manner well known per se.

The outlet area of the rotary kiln 1, the grate cooler 3 and the inlet area of the pipe cooler 2 are surrounded by a housing 6 the upper portion of which is shown in FIG. 1 in cross section. The cooling air required for the grate cooler is drawn up by two blowers 7 and 8 and is supplied in the usual manner through suitable conduits to the area beneath the grate coolers 3. This cooling air, after flowing through the layer of materials to be cooled located on the grate enters into the rotary kiln 1 and serves to support the combustion as secondary air. The secondary air is introduced into the burner (not shown) in the rotary kiln 1.

The movement of the cooling air through the pipe coolers 2 in the direction of the arrows 9 takes place by means of blowers (not shown) which operate either at the material outlet end of the pipe cooler in pressure operation or at the material inlet in the rotary kiln or a heat exchanger connected in series with the same in vacuum type operation. Since the quantity of cooling air reaching the rotary kiln 1 must be limited with regard to the thermal process to be carried out in the rotary kiln, or the furnace temperature, respectively, there are located on the housing 6 cooling air removal conduits 10 and 11 which are equipped with regulating members such as valves 12 and 13. The cooling air deflected through the conduits 10 and 11 may either be released into the ambient atmosphere after recovery of its heat content through heat exchanger and dust removal, or it may serve wholly or partially as combustion air of a second firing of a rotary kiln-heat exchanger installation. In this manner, the cooling output may be varied within wide limits without impairing the thermal process in the rotary kiln.

The grate coolers 3 are preferably constructed as thrust grating coolers. This offers the advantage that deposits and obstructions of the material which are very non-homogeneous as to grain size are prevented and at the same time a uniform distribution, feed and cooling effect are obtained. Through the proper selection of the gap width of the thrust grating, a predetermined grain size fraction can be cooled there so that the pipe coolers 2 connected in series are relieved of this necessity, and circulation of dust in the area of pipe coolers and grate coolers is minimized. The material separated in the area of the grate coolers is collected through two hot material conveyor belts 14 and 15 extending beneath the grate coolers perpendicularly to the direction of feed of the rotary kiln. These belts supply a further hot material belt 16 by means of which the material is subsequently admixed with the cooled material leaving the pipe coolers 2.

The distributor member is advantageously slidably mounted for movement in the horizontal direction as indicated by arrow 17. It may consist of a body having a prismatic configuration in its upper portion, including two inclined sides on which the material to be cooled trickles down. For the prevention of deposits or caking as well as for diminishing wear, the distributor is suitably cooled. Such cooling may take place, for example, indirectly by applying a cooling means to a side of the inclined surface which faces away from the materials to be cooled.

The distributor member 4 because of its slidable position can always be brought into such a position that both grate coolers and consequently both pipe coolers are acted upon uniformly with the material to be cooled. A uniform stress of both the pipe coolers and grate coolers is desirable both for reasons of wear as well as for reasons of economy of heat. The temperature differences of both streams of material resulting from a non-uniform stress of the cooler may be used as a regulating means to adjust the displacement of the distributor member 4 and thereby achieve a uniform charging of both the grate and pipe coolers.

Figure 2:
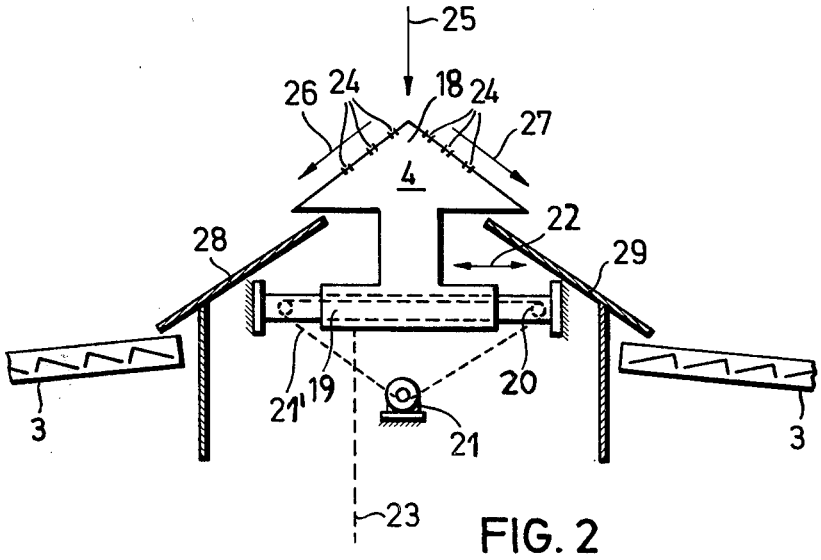
FIG. 2 illustrates one embodiment of a suitable distributor member taken as illustrated by the line II in FIG. 1, on an enlarged scale.

In FIG. 2 there is illustrated an embodiment of a distributor member produced according to the present invention. The distributor member 4 is shown with grate coolers 3 on both sides which, as mentioned, are preferably thrust-grating coolers. The distributor member 4 may consist of an upper, prismatic section 18 which because of its geometrical form distributes the material discharged from the rotary kiln 4 and a lower portion 19 which serves for the support and guidance of the distributor member 4. The distributor member 4 is horizontally guided on one or more rail type carrier members 20. A stationary motor 21 provides for horizontal movement of the distributor member 4 in the direction of the arrows 22. Power transfer for the motor 21 to the distributor member 4 takes place, for example, through a chain 21' shown in dotted lines, which chain is driven by the motor.

Dashed line 23 illustrates a flexible feed pipe for supplying a cooling medium to the distributor member 4. The cooling medium which may be water, for example, may be injected under pressure by means of nozzles 24 arranged in the inclined surfaces of the distributor member 4 directly onto the layer of materials to be cooled trickling over the inclined surfaces. Because of the high kinetic energy of the water flowing out and the pressure of the steam developing, the tendency to agglomerate and form deposits of materials leaving the rotary kiln are disturbed so that a smooth operation is insured. The injection of the cooling medium may take place continuously or in intervals, for example, when the formation of agglomerates exceeds a tolerable degree.

It is also possible to cause indirect cooling of the distributor member by the cooling medium, whereby the cooling medium is conveyed in circulation through the distributor and its heat is released at suitable points during such circulation.

The material leaving the rotary kiln 1 because of rotation of the kiln, leaves eccentrically in the direction of the arrows 25 and is divided by the distributor member 4 into two partial streams represented by arrows 26 and 27. These streams are directed onto two short platforms 28 and 29 onto the thrusting grates 3. The conveyance of the particles then takes place because of the movement inherent in these thrusting grates. This type of structure has the advantage, compared to utilizing inclined grates, whose inclination with reference to the conveyor must be greater than the angle of repose of the material to be conveyed, that even with a feed over relatively large horizontal stretches, a flat type of construction of grate cooler is possible. Furthermore, the structural height of the rotary kiln and the portions of the assembly in the area between the rotary kiln and the pipe coolers can be decreased so that a substantial decrease in construction cost of the rotary kiln installation is achieved.

The present invention may, if necessary, include more than two parallel connected pipe coolers or grate coolers, respectively. In that case, for example, two or more distributor members 4 as shown in FIG. 2, viewed in the direction of material flow, may be connected consecutively so that a corresponding distribution of the entire stream of material results. Also, other types of distributor members may be employed. Through a continuous measuring of temperature differences of the grate coolers or pipe coolers, the position of the distributor can be automatically adjusted so that a uniform impacting of all cooling aggregates is insured.

It will be understood that various modifications can be made to the described embodiments without departing from the scope of the present invention.

We claim as our invention:

1. An apparatus for the cooling of cement clinker or the like being discharged from a rotary kiln, said apparatus comprising:

at least two pipe coolers arranged in parallel with each other, at least two air cooled grate coolers, each grate cooler being arranged to deliver partly cooled material to one of said pipe coolers, and adjustably positionable distributor means positioned to proportion the discharge of said rotary kiln selectively between each of said grate coolers.

2. An apparatus according to claim 1 which also includes:

a plurality of inclined platforms interposed between said kiln and said grate coolers to deliver material onto said grate coolers.

3. An apparatus according to claim 1 in which:

said distributor means includes a prismatic configuration and means for sliding said distributor horizontally to adjustably proportion discharge from said rotary kiln between said two air cooled grate coolers.

* * * * *